United States Patent [19]

Harper et al.

[11] 4,156,163

[45] May 22, 1979

[54] COUPLED CAVITY STRUCTURE

[75] Inventors: Robert Harper, Concord; Robert M. Unger, Wayland, both of Mass.

[73] Assignee: Raytheon Company, Lexington, Mass.

[21] Appl. No.: 834,040

[22] Filed: Sep. 19, 1977

[51] Int. Cl.[2] ..... H01J 25/34

[52] U.S. Cl. ..... 315/3.5; 165/185; 313/42; 313/3.6

[58] Field of Search ..... 315/3.5, 3.6; 313/42; 165/185; 29/600, 601, 25.16; 357/81

[56] References Cited

U.S. PATENT DOCUMENTS

| | | | |
|---|---|---|---|
| 3,453,491 | 7/1969 | Cerko | 315/3.5 |
| 3,778,665 | 12/1973 | Harper et al. | 315/3.5 |
| 3,949,263 | 4/1976 | Harper | 315/3.5 |

*Primary Examiner*—Saxfield Chatmon, Jr.

*Attorney, Agent, or Firm*—John T. Meaney; Joseph D. Pannone; Harold A. Murphy

[57] ABSTRACT

A travelling wave tube of the coupled cavity type including a slow wave propagating structure comprised of a linear array of transverse plates axially spaced apart to provide a sequential series of interposed cavities, each of the plates having a cavity coupling aperture radially spaced from an electron beam transmitting aperture and spanned by at least one thermally conductive, dielectric member made of diamond material, which has respective surface areas disposed in thermal contact with opposing side walls of the cavity coupling aperture.

15 Claims, 4 Drawing Figures

COUPLED CAVITY STRUCTURE

BACKGROUND OF THE INVENTION

1. Field of the Invention

This invention relates generally to wave propagating structures and is concerned more particularly with a travelling wave tube having a coupled cavity type of slow wave structure provided with improved heat dissipating means.

2. Discussion of the Prior Art

A travelling wave tube usually includes an elongated envelope having in one end portion thereof an electron gun disposed to direct an electron beam axially through a slow wave structure to a collector electrode in the other end portion of the envelope. A slow wave structure of the coupled cavity type generally comprises a conductive conduit having therein a linear array of transverse partition plates axially spaced apart to provide a sequential series of interposed cavities. The partition plates usually are provided with respective central apertures which are axially aligned with one another to permit passage of the electron beam sequentially through the cavities to the collector electrode.

The tube envelope generally is provided with suitably spaced input and output means for introducing radio frequency (RF) wave energy into a cavity adjacent the electron gun, and for extracting corresponding amplified wave energy from a cavity adjacent the collector electrode. The RF wave is propagated through the slow wave structure by way of respective cavity coupling slots eccentrically disposed in the partition plates and radially spaced from the respective central apertures therein. The cavity coupling slots may be arranged in staggered relationship by disposing adjacent slots on opposing sides of the structural centerline to provide a folded waveguide type of propagating structure. As a result, the RF wave is propagated along the slow wave structure with an effective axial velocity comparable to the velocities of the electrons in the axially directed beam. Consequently, in successive cavities of the structure, the RF wave interacts with electrons in the beam to obtain therefrom a net transfer of energy whereby the RF wave is amplified.

It is well known that the propagation bandwidth of the described slow wave structure is determined by the sizes of the coupling cavity slots in the respective partition plates. Thus, for broad bandwidth amplification, the coupling cavity slots generally are provided with correspondingly large sizes by disposing them accurately in spaced concentric relationship with the respective central apertures in the plates. As a result, each of the cavity coupling slots is separated from the associated central aperture by an interposed arcuate web of plate material having respective ends integrally joined to the remaining larger portion of the plate. Since the inner surface of the arcuate web constitutes a wall portion of the central aperture, it is subjected to electron bombardment and rises to a prohibitively high temperature with increasing power requirements of the tube. Also, due to its restricted cross-section, the arcuate web cannot readily conduct the excess heat generated therein to the larger portion of the partition plate. Thus, due to its poor heat dissipation properties, the arcuate web of plate material is a limiting factor in the power handling capability of the tube.

Therefore, it is necessary and desirable to provide a travelling wave tube of the coupled cavity type with improved heat dissipating means for enhancing the power handling capacity of the tube.

SUMMARY OF THE INVENTION

Accordingly, this invention provides a travelling wave tube of the coupled cavity type including an elongated envelope having in one end portion an electron gun disposed to direct an electron beam through a slow wave propagating structure to a collector electrode in the other end portion of the envelope. The wave propagating structure comprises a conductive conduit having therein a linear array of transverse partition plates axially spaced apart to provide a sequential series of interposed cavities. Each of the plates has centrally disposed therein an electron beam transmitting aperture, and has eccentrically disposed therein a cavity coupling slot. The slot is radially spaced from the centrally disposed aperture by an interposed web of plate material having opposing ends integrally joined to a larger portion of the plate.

The cavity coupling slots in the respective partition plates are bridged or spanned by respective diamond thermal coupling means for conducting heat from the web to the larger portion of the plate more rapidly than the plate material itself. Each of the thermal coupling means comprises at least one diamond member having respective end portions bonded in a thermally contacting manner to plate material on opposing sides of the spanned slot. Since natural diamond has a thermal conductivity two to five times greater than the thermal conductivity of copper, each of the diamond members provides a more efficient heat conductive path than the opposing ends of the web integrally joined to the larger portion of the plate. Furthermore, since natural diamond has a dielectric constant of about 5.8, it has been found that a properly sized diamond member will not significantly overload the coupling capacity of the spanned slot, as would be expected with a ceramic material having equivalent heat dissipation characteristics, such as beryllia, for example.

Preferably, each of the diamond members is provided in the form of a block which occupies no more than five percent of the spanned slot opening. However, the diamond member may have any configuration, and may occupy ten percent or more of the spanned slot opening, depending on the desired operating parameters of the tube. Furthermore, each of the diamond thermal coupling means may comprise two or more diamond members which have respective surface portions bonded to plate material adjacent opposing sides of the spanned slot. Preferably, the plurality of diamond members are symmetrically disposed in the spanned slot. Also, each of the diamond members may be provided with a respective flanged end disposed in abutting relationship with plate material adjacent the slot opening and bonded thereto for thermally contacting a larger portion of the plate.

BRIEF DESCRIPTION OF THE DRAWINGS

For a more complete understanding of this invention, reference is made in the following detailed description of the accompanying drawings wherein.

DESCRIPTION OF THE PREFERRED EMBODIMENTS

Figure 1:
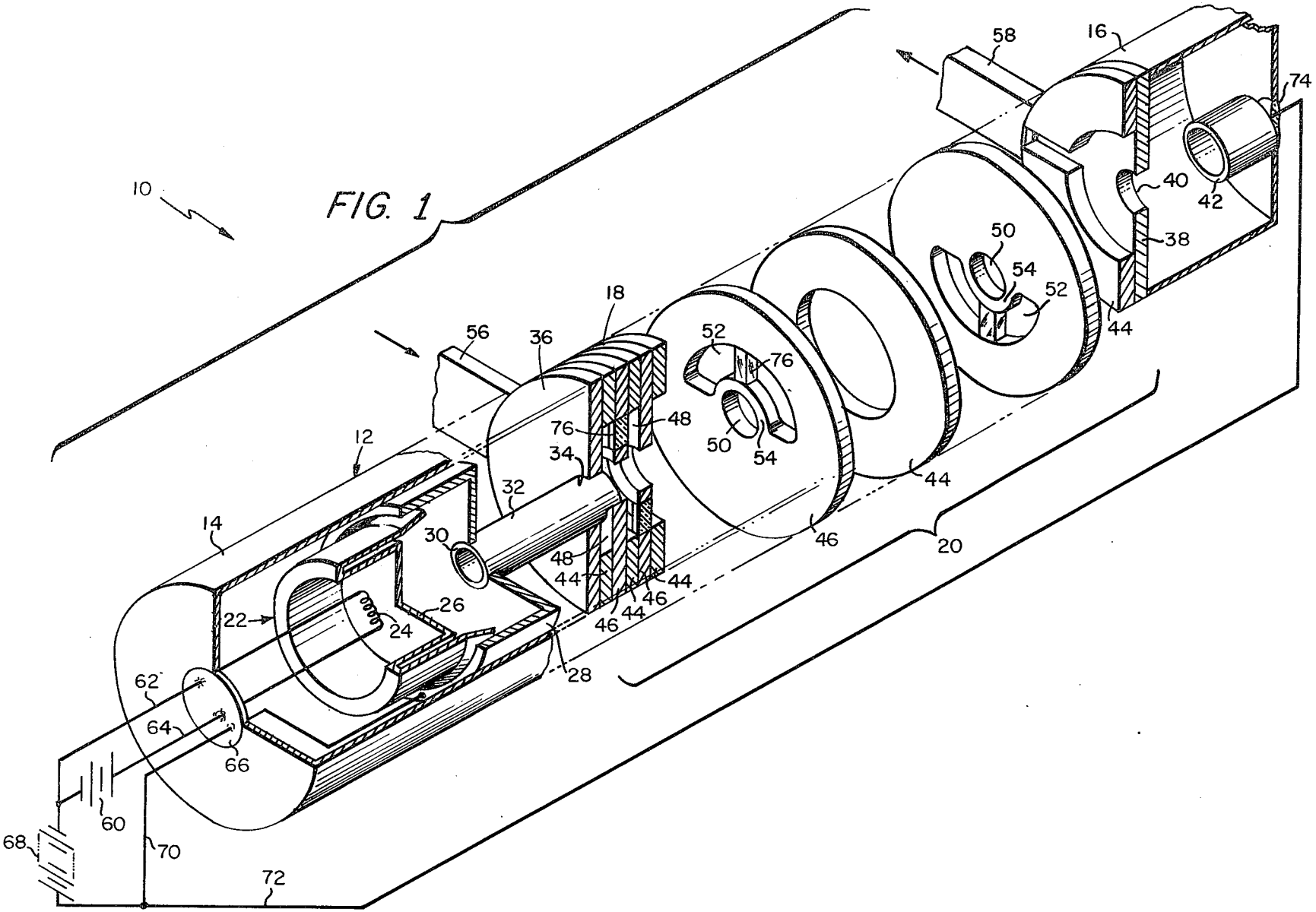
FIG. 1 is an exploded view, partly in section, of a coupled cavity type of travelling wave tube embodying the invention.

Referring to the drawings wherein like characters of reference designate like parts, there is shown in FIG. 1 a travelling wave tube 10 of the coupled cavity type having an elongated conductive envelope 12. The envelope 12 includes opposing cup-shaped end portions, 14 and 16, respectively, which are made of conductive material, such as copper, for example, and have respective open ends peripherally sealed to an intermediate portion 18 of envelope 12. Intermediate portion 18 constitutes a conductive conduit comprising hermetically attached, outer peripheral portions of a slow wave structure 20, which is axially disposed between the respective end portions 14 and 16 of envelope 12.

Insulatingly supported by well known means within the portion 14 is a conventional electron gun 22 including an electrically heated filament 24 disposed within a cathode cup 26. The cathode cup 26 has an exterior end surface which emits electrons when heated, and is disposed in spaced coaxial relationship with a cup-shaped accelerator electrode 28. Aligned with the electron emitting end surface of cathode cup 26 is an aperture 30, which is centrally disposed in the closed end of accelerator electrode 28 and has secured therein, as by brazing, for example, an end portion of an axially extending drift tube 32. The opposing end portion of drift tube 32 is similarly secured in an aperture 34 which is centrally disposed in a cylindrical end plate 36 made of conductive material, such as copper, for example. The plate 36 constitutes one end of the slow-wave structure 20 which has an opposing end comprised of a cylindrical end plate 38 made of conductive material, such as copper, for example. An aperture 40 centrally disposed in end plate 38 is aligned with an open end of a conventional cup-shaped collector electrode 42, which is insulatingly supported by well-known means in the end portion 16 of envelope 12. Outer peripheral portions of the end plates 30 and 38 are circumferentially attached, as by brazing, for example, to the adjacent open ends of envelope end portions 14 and 16, respectively.

Between the end plates 36 and 38, the slow wave structure 20 is comprised of an axially aligned array of alternate rings 44 and slotted cylindrical plates 46 disposed in juxtaposed relationship with one another and with the end plates 36 and 38, respectively. The rings 44 and slotted plates 46 are made of conductive material, such as copper, for example. The plates 36, 38 and 46 have respective outer peripheral portions circumferentially attached, as by brazing, for example, to the adjacent surfaces of the interposed rings 44 to constitute the conductive conduit comprising intermediate envelope portion 18. Thus, the rings 44 axially space the slotted plates 46 from the end plates 36 and 38, respectively, and from one another to provide a sequential series of interposed cavities 48.

The slotted plates 46 are provided with respective central apertures 50 which are axially aligned with one another and with the central apertures 34 and 40 in end plates 36 and 38, respectively. Also, each of the plates 46 has eccentrically disposed therein an arcuate slot 52 which is concentric with the respective central aperture 50 and is radially spaced therefrom by an arcuate web 54. Consequently, each of the webs 54 is integrally joined to the remaining larger portion of the respective plate 46 only by its opposing end portions. The slots 52 are disposed in staggered relationship along the slow wave structure 20 by disposing adjacent slots 52 on opposing sides of the axial centerline thereof. The ring 44 adjacent end plate 36 is provided with conventional input transmission means 56 for introducing an RF wave into the cavity 48 adjacent the electron gun 22. Similarly, the ring 44 adjacent end plate 38 is provided with conventional output transmission means 58 for extracting a corresponding amplified RF wave from the cavity 48 adjacent the collector electrode 42.

In operation, the filament 24 is electrically connected to respective terminals of a current source 60 located externally of envelope 12 by suitable means, such as respective conductors 62 and 64 passed through a dielectric member 66 sealed in the closed end of envelope portion 14, for example, Also, the filament 24 is electrically connected, as by conductor 62, for example, to a negative terminal of a high voltage source 68 which has a positive terminal electrically connected, as by a conductor 70, for example, to the accelerator electrode 28. The positive terminal of high voltage source 68 also is electrically connected to the collector electrode 42 by suitable means, such as conductor 72 passed through a dielectric member 74 sealed in the closed end of envelope portion 16, for example. The input transmission means 56 is connected to a radio frequency energy source (not shown), and the output transmission means 58 is connected to an RF load (not shown).

Thus, filament 24 heats cathode cup 26 to a suitable temperature for producing a copious emission of electrons, which are electrostatically focused into a beam by the accelerator electrode 28. The electron beam passes axially through drift tube 32, central apertures 50 in plates 46, and central aperture 40 in end plate 38 to the collector electrode 42. Also, an RF wave is introduced into the cavity 48 adjacent end plate 36 by way of the input means 56 and is propagated sequentially through the successive cavities 48 of slow wave structure 20 by means of the staggered arrangement of cavity coupling slots 52 in the plates 46. As a result, the RF wave is propagated through the structure 20 with an effective axial velocity comparable to the velocities of electrons in the axially directed beam. Consequently, in successive cavities 48 of the structure 20, the RF wave interacts with electrons in the axially directed beam to obtain therefrom a net transfer of energy, which amplifies the RF wave. Accordingly, a corresponding amplified RF wave is transmitted from the cavity 48 adjacent collector electrode 42 through the output means 58.

During the described operation, electrons in the beam passing through the respective apertures 50 impinge on the peripheral walls thereof and have their kinetic energies converted to thermal energy. The resulting heat generated in the larger mass portions of the respective plates 46 is readily conveyed to the conductive envelope 12, where it may be dissipated by suitable means, such as an external heat sink (not shown), for example. Accordingly, the all metal structure of the described type of tube is particularly well adapted for high power amplification of RF waves. However, the heat generated in the arcuate webs 54 is not as readily dissipated, due to their respective narrow cross-sections and the limited number of conduction paths provided by their respective opposing end portions. Consequently, when the electron flow between gun 24 and collector electrode 42 is increased to meet high power requirements, the temperatures of the arcuate webs 54 become prohibitively high. Thus, the power handling capacity of the tube is limited by the poor heat dissipation properties of the arcuate webs 54.

Therefore, in accordance with this invention, each of the slots 52 in the described tube 10 is bridged or spanned by a respective dielectric thermal coupling means comprising a diamond member 76 having respective surface portions bonded to plate material adjacent opposing sides of the slot for conducting heat across the opening thereof. The diamond member 76 may be bonded to the plate material by any suitable means, such as the method disclosed in U.S. Pat. No. 3,949,263 granted to R. Harper on Apr. 6, 1977 and assigned to the assignee of this invention, for example. Preferably, the diamond member 76 comprises a block of natural diamond material dimensioned for fitting entirely into a slot 52 and having opposing surfaces bonded to opposing wall surfaces of the slot. Since heat is conducted more readily from the end portions of a web 54 than from the central portion thereof, the diamond block member 76 preferably is disposed centrally in the respective slot. Thus, the diamond member 76 provides an additional path for conducting heat from the central portion of web 54 to a large mass portion of the associated plate 46.

Since natural diamond has a thermal conductivity two to five times greater than the thermal conductivity of copper, each of the diamond block members 76 provides a more efficient heat conduction path than the plate material at the opposing end portions of the respective web 54, which portions are integrally joined to the larger mass portion of the associated plate 46. Furthermore, since natural diamond has a dielectric constant of about 5.8, a diamond member 76 properly sized for conducting heat, as desired, from a web 54 will not significantly increase the dielectric loading of the spanned slot 52 and therefore, would not significantly decrease the gain of the tube, as would be expected with larger spanning members made of ceramic material having equivalent heat dissipation characteristics, such as beryllia, for example. Preferably, the diamond block member 76 occupies no more than five percent of the spanned slot opening. However, the diamond member 76 may have any configuration desired, and may occupy ten percent or more of the spanned slot opening, depending on the required operating parameters of the tube.

Figure 4:
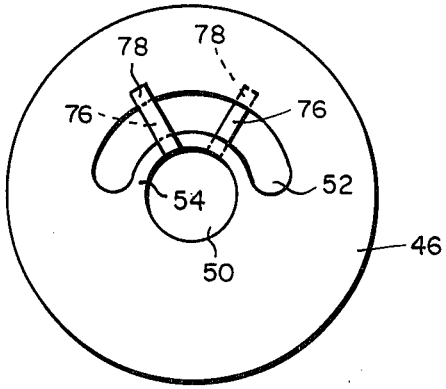
FIGS. 3 and 4 are end and elevational views, respectively, of a partition plate shown in FIG. 1 but having a second alternative embodiment of this invention.
Figure 3:
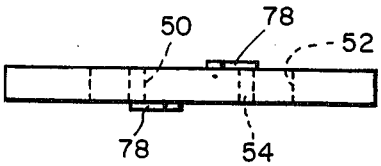
Figure 2:
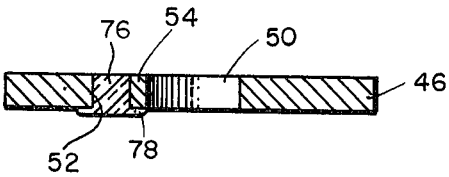
FIG. 2 is a transverse sectional view of a partition plate shown in FIG. 1 but having an alternative embodiment of this invention.

As shown in FIG. 2, the diamond member 76 may be provided with an end flange 78, which also may be bonded to plate material adjacent opposing sides of the spanned slot 52, thereby providing additional thermal coupling for conducting more heat from the web 54 to opposing sides of the slot 52. Also, as shown in FIGS. 3 and 4, the thermal coupling means may comprise two diamond block members 76, which preferably are spaced symmetrically apart in a spanned slot 52 and may be provided with respective end flanges 78. The respective end flanges 78 may abut opposing surfaces of the associated plate 46 and be bonded to plate material adjacent the spanned slot 52.

Thus, there has been disclosed herein a thermal coupling diamond means for spanning respective slotted openings in the partition plates of a coupled cavity type of a slow wave propagating structure and for enhancing the power handling capacity thereof.

From the foregoing, it will be apparent that all of the objectives of this invention have been achieved by the structure shown and described. It also will be apparent, however, that various changes may be made by those skilled in the art without departing from the spirit of the invention as expressed in the appended claims. It is to be understood, therefore, that all matter shown and described is to be interpreted as illustrative rather than in a limiting sense.

What is claimed is:

1. A wave propagating structure comprising:
- a hollow conductive conduit having spaced radio frequency wave input and output means;
- a conductive partition disposed transversely in the conduit between the input and output means, the partition having a coupling slot therein; and
- a diamond member disposed in the slot and having respective portions thermally connected to partition material adjacent opposing sides of the slot.

2. A wave propagating structure as set forth in claim 1 wherein the diamond member comprises a block of diamond material dimensioned to fit within the slot and having opposing portions thermally connected to opposing sides of the slot.

3. A wave propagating structure as set forth in claim 2 wherein the diamond member includes an end flange having respective portions thermally connected to partition material adjacent opposing sides of the slot.

4. A wave propagating structure as set forth in claim 2 wherein the block of diamond material is dimensioned to occupy no more than five percent by volume of the slot.

5. A slow wave propagating structure comprising:
- a hollow conductive conduit having spaced radio frequency input and output means;
- an aligned array of mutually spaced partitions made of conductive material and disposed transversely in the conduit between the input and output means, each of the partitions having therein a respective central aperture and an eccentric coupling slot spaced apart by interposed partition material; and
- respective diamond members disposed in each of the coupling slots and having portions thermally connected to partition material adjacent the slot.

6. A slow wave propagating structure as set forth in claim 5 wherein each of the slots is arcuate and concentrically spaced from the associated central aperture by a respective interposed web of partition material.

7. A slow wave propagating structure as set forth in claim 6 wherein the slots in adjacent partitions are disposed on respective opposing sides of the axial centerline of the conduit.

8. A slow wave propagating structure as set forth in claim 5 wherein each of the diamond members comprises a block of diamond material having opposing portions thermally connected to opposing side walls of the respective slot.

9. A slow wave propagating structure as set forth in claim 8 wherein each of the diamond members comprises a block of diamond material dimensioned to fit within the respective slot and to occupy no more than five percent by volume of the slot.

10. A slow wave propagating structure as set forth in claim 6 wherein each of the diamond members is disposed in a central portion of the respective slot and has a portion thermally connected to a central portion of the respective web of partition material.

11. A travelling wave tube of the coupled cavity type comprising:
- an elongated envelope;

electron gun means disposed in one end portion of the envelope for directing an electron beam axially of the envelope;

collector electrode means disposed in the other end portion of the envelope for receiving the electron beam;

a slow wave structure disposed axially between the electron gun means and the collector electrode means and including;

a conductive conduit having spaced radio frequency wave input and output means;

a linear array of axially spaced partitions made of conductive material and transversely disposed in the conduit, each of the partitions having therein a centrally disposed electron beam transmitting aperture and an eccentrically disposed cavity coupling slot spaced apart by an interposed portion of integral partition material; and respective diamond members disposed in each cavity coupling slot and having portions thermally connected to partition material adjacent opposing sides of the slot.

12. A travelling wave tube as set forth in claim 11 wherein each of the cavity coupling slots is arcuate and concentrically spaced from the respective electron beam transmitting aperture by an interposed arcuate web of integral partition material; and the cavity coupling slots in adjacent partitions of the array are disposed on respective opposing sides of the axial centerline of the slow wave structure.

13. A travelling wave tube as set forth in claim 12 wherein each of the diamond members comprises a block of diamond material dimensioned to fit in the respective cavity coupling slot and having respective opposing portions thermally connected to opposing side walls of the slot.

14. A travelling wave tube as set forth in claim 12 wherein each of the diamond members is centrally disposed in the respective slot and has one of its opposing portions thermally connected to a central portion of the web.

15. A travelling wave tube as set forth in claim 14 wherein each of the diamond members includes an end flange having respective portions thermally connected to partition material adjacent opposing sides of the respective slot.

* * * * *